US008555464B2

(12) United States Patent
Bannon

(10) Patent No.: US 8,555,464 B2
(45) Date of Patent: Oct. 15, 2013

(54) ADJUSTABLE HINGE ASSEMBLY

(75) Inventor: Sean A. Bannon, Bloomfield Hills, MI (US)

(73) Assignee: Chrysler Group LLC, Auburn Hills, MI (US)

( * ) Notice: Subject to any disclaimer, the term of this patent is extended or adjusted under 35 U.S.C. 154(b) by 3 days.

(21) Appl. No.: 13/329,402

(22) Filed: Dec. 19, 2011

(65) Prior Publication Data

US 2013/0152340 A1 Jun. 20, 2013

(51) Int. Cl.
*E05D 7/04* (2006.01)

(52) U.S. Cl.
USPC ..... 16/237; 16/239; 16/247; 16/246

(58) Field of Classification Search
USPC ..... 16/236, 237, 242, 238, 239, 248, 367, 16/240, 245, 105, 33, 34; 296/146.11, 296/146.12, 207, 79, 96, 146.8
See application file for complete search history.

(56) References Cited

U.S. PATENT DOCUMENTS

| | | | | | |
|---|---|---|---|---|---|
| 2,688,764 | A | | 9/1954 | Squire | |
| 3,234,584 | A | * | 2/1966 | Valade | 16/370 |
| 4,070,728 | A | * | 1/1978 | Herman | 16/243 |
| 4,186,476 | A | | 2/1980 | Mair et al. | |
| 4,658,470 | A | | 4/1987 | Oen | |
| 4,893,863 | A | * | 1/1990 | Skonieczny et al. | 296/76 |
| 5,074,609 | A | * | 12/1991 | Dear | 296/76 |
| 5,584,099 | A | * | 12/1996 | Westerdale | 16/245 |
| 5,826,306 | A | * | 10/1998 | Faubert et al. | 16/244 |
| 5,873,619 | A | * | 2/1999 | Lewkoski et al. | 296/76 |
| 5,967,586 | A | * | 10/1999 | Duffy et al. | 296/76 |
| 6,178,593 | B1 | * | 1/2001 | Carlson | 16/82 |
| 6,643,895 | B1 | | 11/2003 | Domenig et al. | |
| 6,701,572 | B2 | * | 3/2004 | Bechthold | 16/235 |
| 7,350,845 | B1 | * | 4/2008 | Duffy | 296/76 |
| 7,469,953 | B2 | * | 12/2008 | Heath et al. | 296/76 |
| 2003/0159247 | A1 | | 8/2003 | Schott | |
| 2009/0271947 | A1 | * | 11/2009 | Krajenke et al. | 16/241 |

FOREIGN PATENT DOCUMENTS

| | | | | |
|---|---|---|---|---|
| DE | 102005042190 | A1 | * | 3/2007 |
| FR | 2707693 | A1 | * | 1/1995 |
| JP | 2003193730 | A | * | 7/2003 |

* cited by examiner

*Primary Examiner* — Chuck Mah
(74) *Attorney, Agent, or Firm* — Frederick A. Krieger

(57) ABSTRACT

A hinge assembly may include a hinge bracket, a pivot member and a hinge arm. The hinge bracket may be adapted to be mounted to a frame member of a vehicle. The pivot member may be connected to the hinge bracket and may be pivotable relative thereto. The hinge arm may be connected to the pivot member and may be pivotable about a longitudinal axis of the pivot member. The hinge arm may be linearly adjustable in a first direction relative to the hinge bracket and linearly adjustable in a second direction relative to the hinge bracket. The first and second directions may be substantially perpendicular relative to each other. The hinge arm may be adapted to be coupled to a closure panel of the vehicle to move the closure panel relative to the frame member between an open position and a closed position.

17 Claims, 11 Drawing Sheets

ADJUSTABLE HINGE ASSEMBLY

FIELD

The present disclosure relates to an adjustable hinge assembly.

BACKGROUND

A vehicle may include a hood, a trunk, doors, a tailgate, and/or one or more other closure panels that are movable between open and closed positions to selectively permit and restrict access to various compartments and/or spaces of the vehicle. Hinge assemblies may couple the closure panels relative to a frame member or other structure of the vehicle. Due to manufacturing tolerances, initial installation of a hinge assembly and a corresponding closure panel onto a vehicle may result in some degree of misalignment between the closure panel and the frame member. Traditionally, such misalignment of the closure panel would be corrected through tedious trial-and-error iterations of moving the closure panel and hinge assembly relative to the frame member until the proper fit and alignment was achieved.

SUMMARY

The present disclosure provides a hinge assembly that may include a hinge bracket, a pivot member and a hinge arm. The hinge bracket may be adapted to be mounted to a frame member of a vehicle. The pivot member may be connected to the hinge bracket and may be pivotable relative thereto. The hinge arm may be connected to the pivot member and may be pivotable about a longitudinal axis of the pivot member. The hinge arm may be linearly adjustable in a first direction relative to the hinge bracket and linearly adjustable in a second direction relative to the hinge bracket. The first and second directions may be substantially perpendicular relative to each other. The hinge arm may be adapted to be coupled to a closure panel of the vehicle to move the closure panel relative to the frame member between an open position and a closed position.

In some embodiments, the closure panel can include a hood of the vehicle. The hinge arm may be linearly adjustable in a third direction relative to the hinge bracket. The third direction may be substantially perpendicular relative to the first and second directions.

In some embodiments, the hinge assembly may include a first cam member coupled to the pivot member that is pivotable about the longitudinal axis relative to the hinge bracket independently of the hinge arm. Pivotal motion of the first cam member relative to the hinge bracket may cause corresponding linear adjustment of the pivot member in the first direction.

In some embodiments, the hinge assembly may include a pivot pin attached to the hinge bracket and a second cam member engaging the pivot pin for pivotable motion relative to the hinge bracket. The hinge bracket may include a base portion and an upright portion extending from the base portion. The base portion may include a reaction member extending therefrom and engaging a peripheral surface of the second cam member. Rotation of the second cam member relative to the hinge bracket may exert a force on the reaction member causing linear movement of the hinge arm relative to the frame member of the vehicle. In some embodiments, pivotal motion of the second cam member relative to the hinge bracket may cause corresponding linear adjustment of the hinge bracket in the second direction. Each of the upright portion and the base portion may include a slot facilitating relative movement between the hinge arm and the frame member.

In some embodiments, the hinge assembly may include a pivot bushing fixedly engaging the hinge arm and threadably engaging the pivot member. Threadable adjustment of the pivot member relative to the pivot bushing may cause corresponding linear adjustment of the hinge arm relative to the hinge bracket in a third direction. The first direction may be perpendicular to the second direction and the first and second directions may be perpendicular to the third direction.

The present disclosure also provides a hinge assembly that may include a hinge bracket, a pivot member, a hinge arm, and a cam member. The hinge bracket may be adapted to be mounted to a frame member of a vehicle. The pivot member may be connected to the hinge bracket and may be pivotable relative to the hinge bracket. The hinge arm may be connected to the pivot member and may be pivotable about a longitudinal axis of the pivot member. The hinge arm may be linearly adjustable relative to the hinge bracket and may be adapted to be coupled to a closure panel of the vehicle to move the closure panel relative to the frame member between an open position and a closed position. The cam member may be coupled to the pivot member and may be pivotable about the longitudinal axis relative to the hinge bracket independently of the hinge arm. Pivotal motion of the cam member relative to the hinge bracket may cause corresponding linear adjustment of the pivot member.

In some embodiments, the hinge assembly may include an adjustment member and a link member connected to the cam member. Movement of the adjust member may cause corresponding movement of the link member. Movement of the link member may cause corresponding movement of the cam member.

In some embodiments, the hinge arm may be independently movable in first and second directions relative to the frame member. The first and second directions may be substantially perpendicular to each other. In some embodiments, the hinge arm may be movable in a third direction relative to the frame member. The third direction may be perpendicular to the first and second directions.

Further areas of applicability of the present disclosure will become apparent from the detailed description, claims and drawings provided hereinafter. It should be understood that the summary and detailed description, including the disclosed embodiments and drawings, are merely exemplary in nature intended for purposes of illustration only and are not intended to limit the scope of the invention, its application or use. Thus, variations that do not depart from the gist of the disclosure are intended to be within the scope of the invention.

When an element or component is referred to as being "on," "engaged to," "connected to," or "coupled to" another element or component, it may be directly on, engaged, connected or coupled to the other element or component, or intervening elements or components may be present. In contrast, when an element or component is referred to as being "directly on," "directly engaged to," "directly connected to," or "directly coupled to" another element or component, there may be no intervening elements or components present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed herein could be termed a second element, component, region, layer or section without departing from the teachings of the example embodiments.

DETAILED DESCRIPTION

Figure 1:
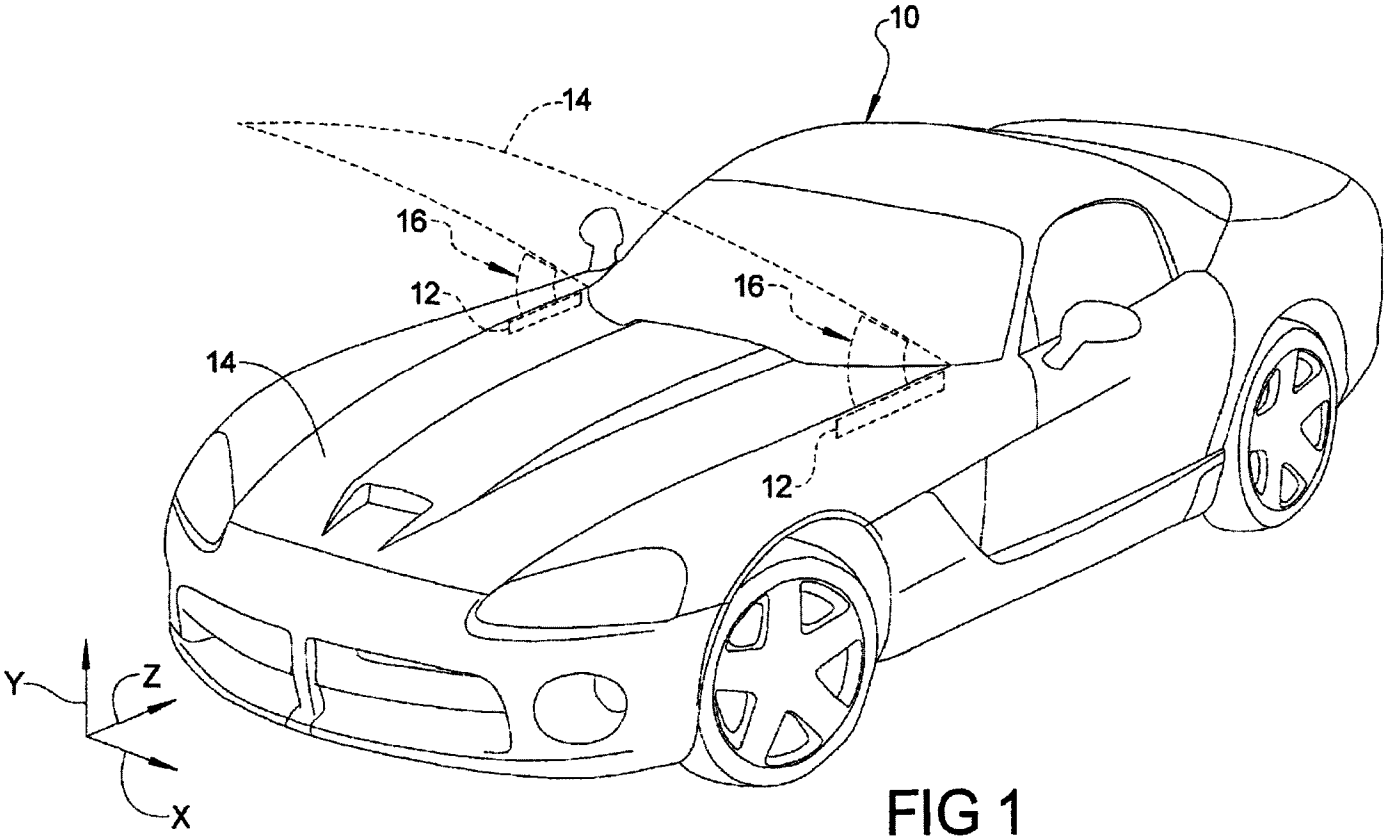
FIG. 1 is perspective view of a vehicle having a hood and a pair of hinge assemblies according to the principles of the present disclosure.

In an exemplary embodiment and with reference to FIG. 1, a vehicle 10 is provided that may include one or more structural members 12 (shown schematically), one or more closure panels 14, and one or more hinge assemblies 16 (shown schematically in FIG. 1). The hinge assemblies 16 may be connected to corresponding structural members 12 and the closure panel 14 and may allow the closure panel 14 to pivot relative to the structural members 12 between an open position (shown in phantom lines in FIG. 1) and a closed position (shown in solid lines in FIG. 1). In various embodiments, the hinge assemblies 16 may be operable to adjust an alignment and fit of the closure panel 14 relative to the structural member 12 in one or more of a lateral dimension X, a vertical dimension Y, and a fore/aft dimension Z. The lateral dimension X may be substantially perpendicular to the vertical dimension Y and the fore/aft dimension Z, and the vertical dimension Y may be substantially perpendicular to the fore/aft dimension Z.

In the particular embodiment shown in FIG. 1, the closure panel 14 is a hood of the vehicle 10 and the structural members 12 may be portions of a frame of a body of the vehicle 10, for example. It will be appreciated that in other embodiments, the structural member 12 could be any other frame member, support member or structural component of the vehicle 10 and the closure panel 14 could be a trunk, a door, a tailgate, a glove compartment, a fuel door, or any other member movable between open and closed positions to selectively permit and restrict access to a compartment and/or space of the vehicle 10. Furthermore, in some embodiments, the closure panel 14 may be connected to the structural member 12 by only a single hinge assembly 16 or any other number of hinge assemblies 16.

Figure 2:
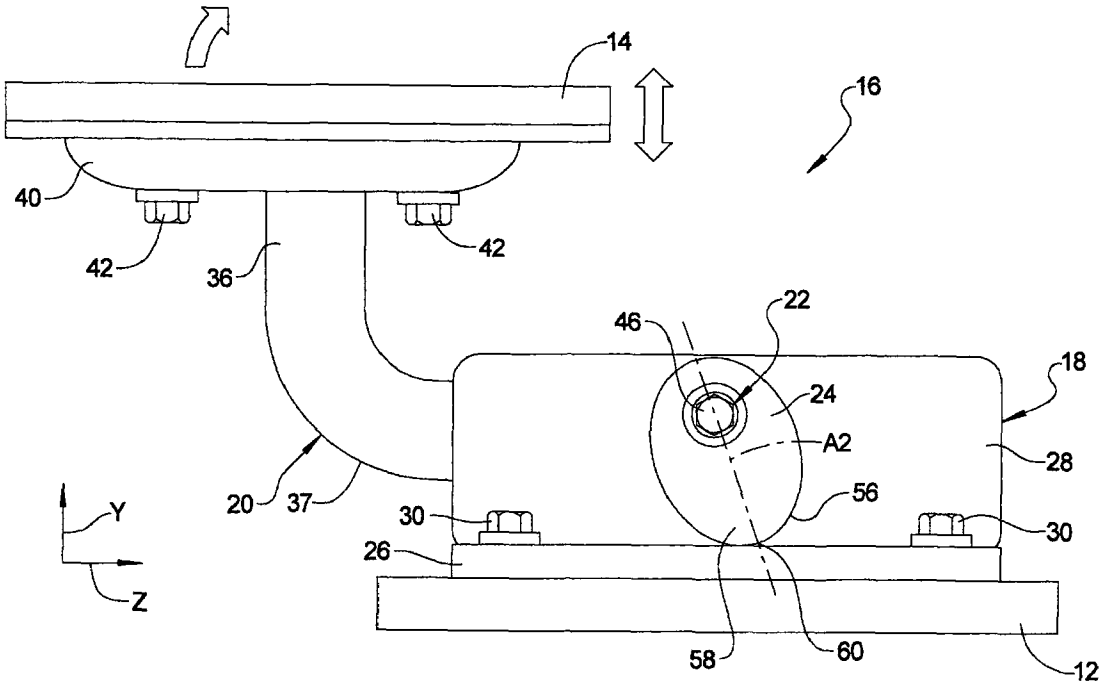
FIG. 2 is side view of a hinge assembly according to the principles of the present disclosure.
Figure 3:
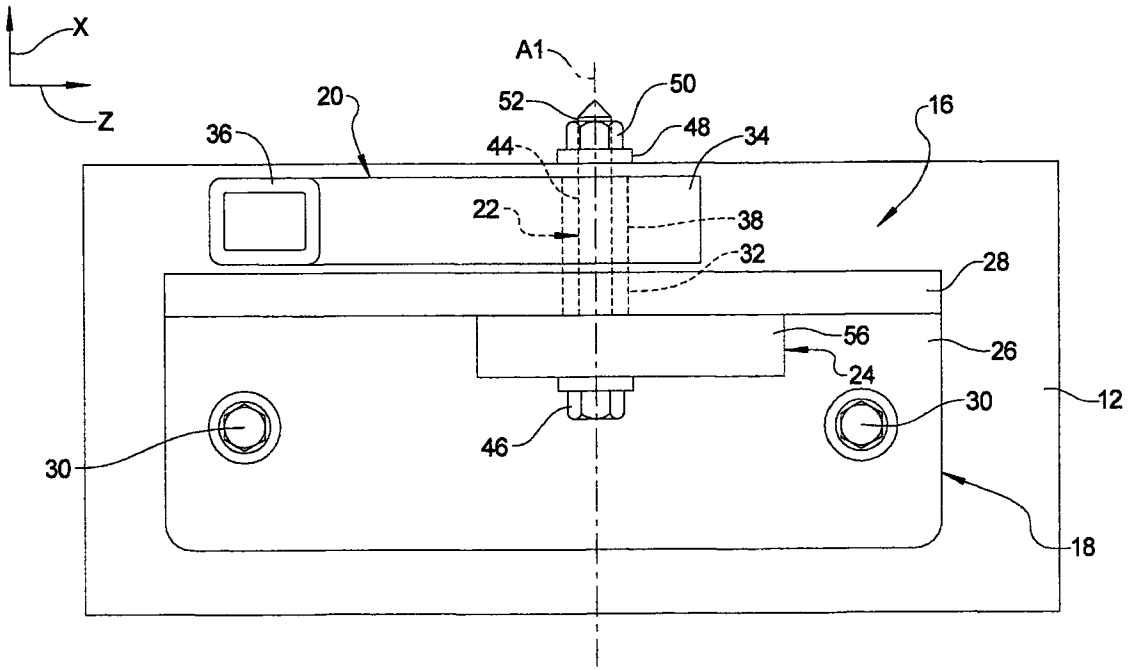
FIG. 3 is a top view of the hinge assembly of FIG. 2.
Figure 4:
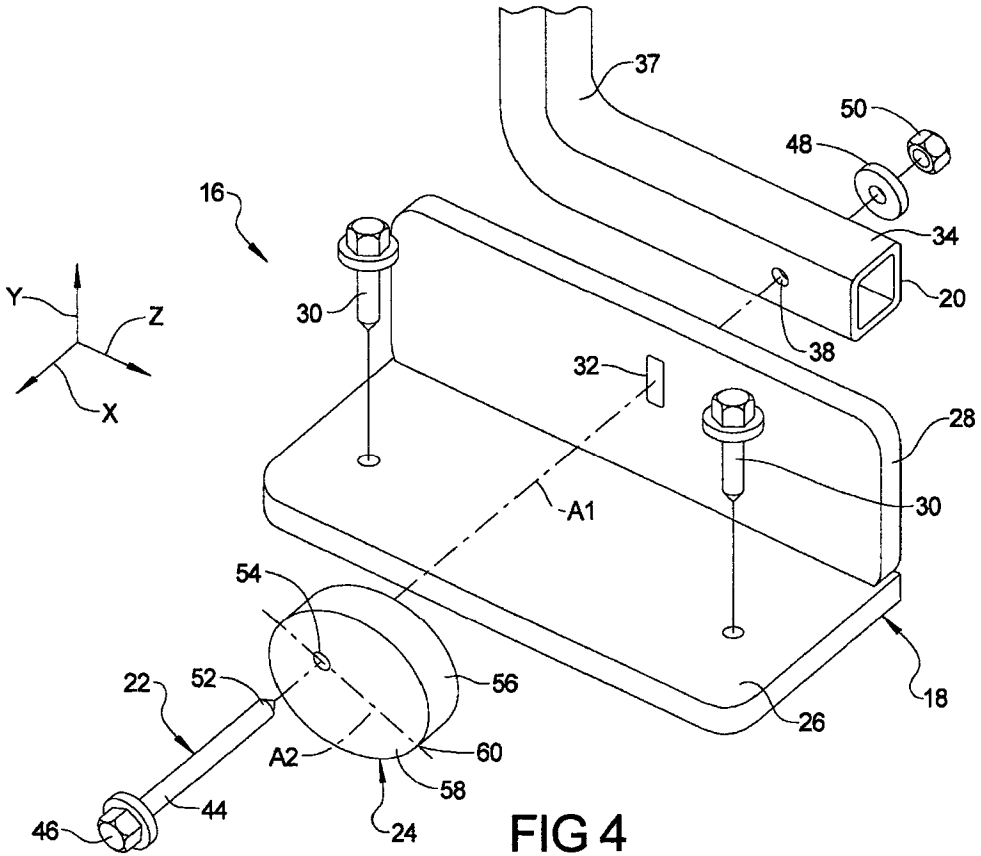
FIG. 4 is an exploded perspective view of the hinge assembly of FIG. 2.

Referring now to FIGS. 2-4, the hinge assembly 16 may include a hinge bracket 18, a hinge arm 20, a pivot member 22, and a cam member 24. The hinge bracket 18 may include a first portion 26 and a second portion 28. The first portion 26 may act as a base of the hinge bracket 18 and may be secured to the structural member 12 via one or more bolts 30, rivets, and/or welds, for example. The second portion 28 may extend from the first portion 26 and may include a slot 32 (FIG. 4) formed therein. The slot 32 may be elongated in the vertical dimension Y and may extend through a thickness of the second portion 28 in the lateral dimension X.

In some embodiments, the second portion 28 may extend from the first portion 26 in a generally upright manner such that the first and second portions 26, 28 may form a generally L-shaped member. The first and second portions 26, 28 could be integrally formed with each other or the first and second portions 26, 28 could be discrete pieces that are welded, bolted and/or otherwise fixed relative to each other. In some embodiments, the hinge bracket 18 may be formed without the first portion 26, in which case, the second portion 28 could be secured directly to the structural member 12.

The hinge arm 20 may include a first end portion 34 and a second end portion 36. In some embodiments, the hinge arm 20 may include an elbow portion 37 and the first and second end portions 34, 36 may be generally perpendicular or angled relative to each other. While FIGS. 3 and 4 depict the hinge arm 20 as a generally hollow member, it will be appreciated that the hinge arm 20 could be a solid member. The first end portion 34 may include an aperture 38 (FIG. 4) that may be substantially aligned with at least a portion of the slot 32 formed in the second portion 28 of the hinge bracket 18. The second end portion 36 may include a flange 40 (FIG. 2) that may be attached to the closure panel 14 via welding and/or one or more fasteners 42, for example.

The pivot member 22 may be a generally elongated pin or bolt, for example, and may include an elongated body portion 44 and a head portion 46. The body portion 44 may define a longitudinal axis A1 and may be received through the slot 32 in the hinge bracket 18 and through the aperture 38 in the hinge arm 20. A washer 48 and a nut 50 and/or any other retaining member may engage an end portion 52 of the body portion 44 and may cooperate with the head portion 46 and the cam member 24 to retain body portion 46 in the slot 32 and aperture 38. The hinge arm 20 may be pivotable about the longitudinal axis A1 of relative to the hinge bracket 18 to move the closure panel 14 between the open and closed positions.

The cam member 24 may be a generally oblong disc having an aperture 54 (FIG. 4) extending therethrough. In some embodiments, the cam member 24 may be welded or otherwise secured to the head portion 46 of the pivot member 22. In some embodiments, the cam member 24 could be integrally formed with the pivot member 22. The cam member 24 may include a peripheral surface 56 defining a lobe 58. The lobe 58 may include a peak 60, which may be defined as the point or portion of the peripheral surface 56 that is further away from the aperture 54 than any other point or portion of the peripheral surface 56. The body portion 44 of the pivot member 22 may extend through the aperture 54 such that the second portion 28 of the hinge bracket 18 is disposed between the cam member 24 and the hinge arm 20. The cam member 24 may be rotatable about the longitudinal axis A1 relative to the hinge bracket 18.

With reference to FIGS. 2-4, operation of the hinge assembly 16 will be described in detail. As described above, the hinge bracket 18 may be fixed relative to the structural member 12, and the hinge arm 20 may be fixed relative to the closure panel 14. The hinge arm 20 may be mounted to the hinge bracket 18 for pivotable motion relative thereto by inserting the body portion 44 of the pivot member 22 through the slot 32 in the hinge bracket 18 and through the aperture 38 in the hinge arm 20.

Alignment of the closure panel 14 relative to the structural member 12 in the vertical dimension Y may be adjusted by rotating the cam member 24 about the longitudinal axis A1 to a position such that the peripheral surface 56 of the cam member 24 is in contact with the first portion 26 of the hinge bracket 18. As the cam member 24 is rotated toward a position where the peak 60 of the lobe 58 is in contact with the first portion 26 (i.e., a position where an axis A2 extending between the peak 60 and the aperture 54 is perpendicular to the first portion 26), the pivot member 22 will correspondingly move linearly upward in the vertical dimension Y within the slot 32, and hence the hinge arm 20 and closure panel 14 will correspondingly move linearly upward in the vertical dimension Y relative to the structural member 12. Conversely, rotating the cam member 24 in a direction that moves the peak 60 away from the first portion 26 of the hinge bracket 18 will cause the pivot member 22 to move linearly downward within the slot 32 in the vertical direction Y, which causes the hinge arm 20 and closure panel 14 to move linearly downward in the vertical dimension Y relative to the structural member 12.

Once the cam member 24 is rotated to a position in which a desired relative alignment between the closure panel 14 and the structural member 12 is achieved, the cam member 24 can be welded, bolted or otherwise fixedly secured to the second portion 28 of the hinge bracket 18 to thereby "lock" the alignment of the closure panel 14 relative to the structural member 12. Of course, even after the cam member 24 is fixedly secured in the desired position relative to the hinge bracket 18, the hinge arm 20 is free to pivot about the longitudinal axis A1 to move the closure panel 14 between the open and closed positions.

Figure 5:
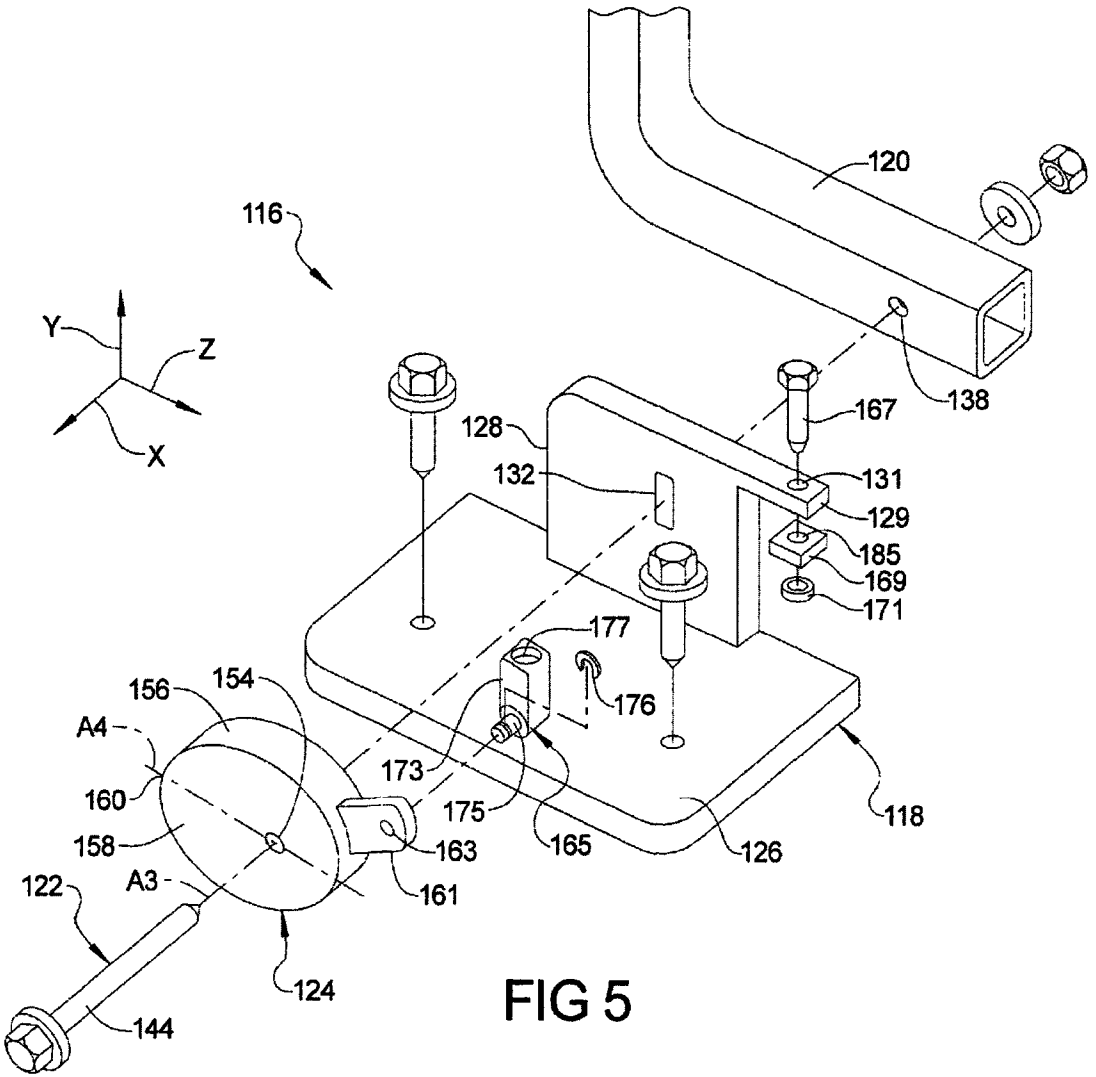
FIG. 5 is an exploded perspective view of a hinge assembly including an adjustment linkage according to the principles of the present disclosure.
Figure 6:
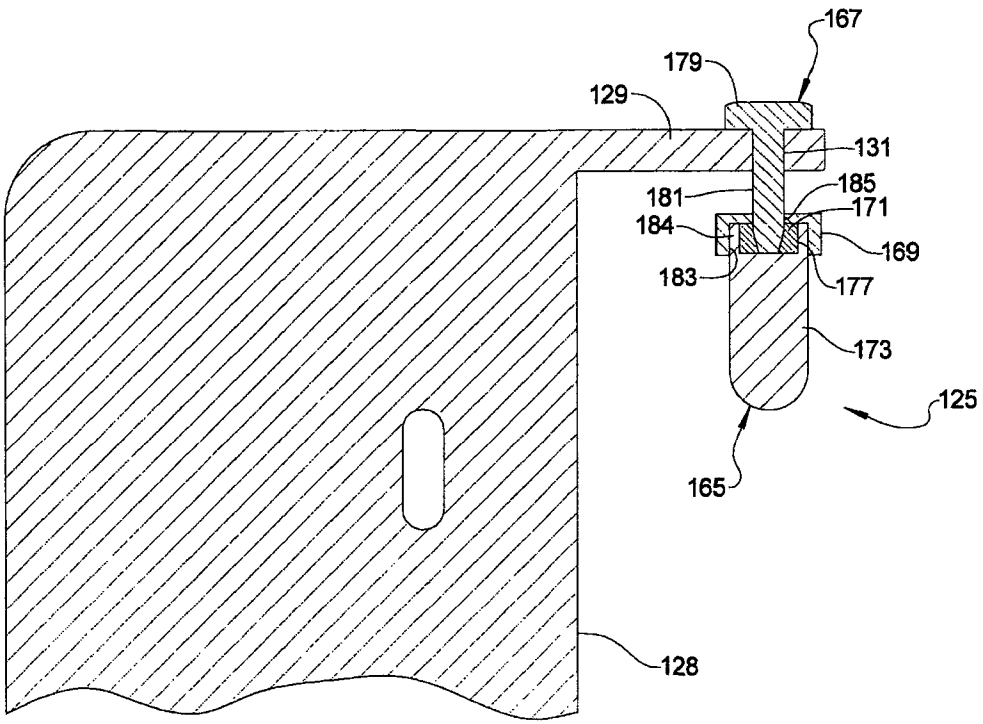
FIG. 6 is a cross-sectional view of the adjustment linkage of FIG. 5.
Figure 7:
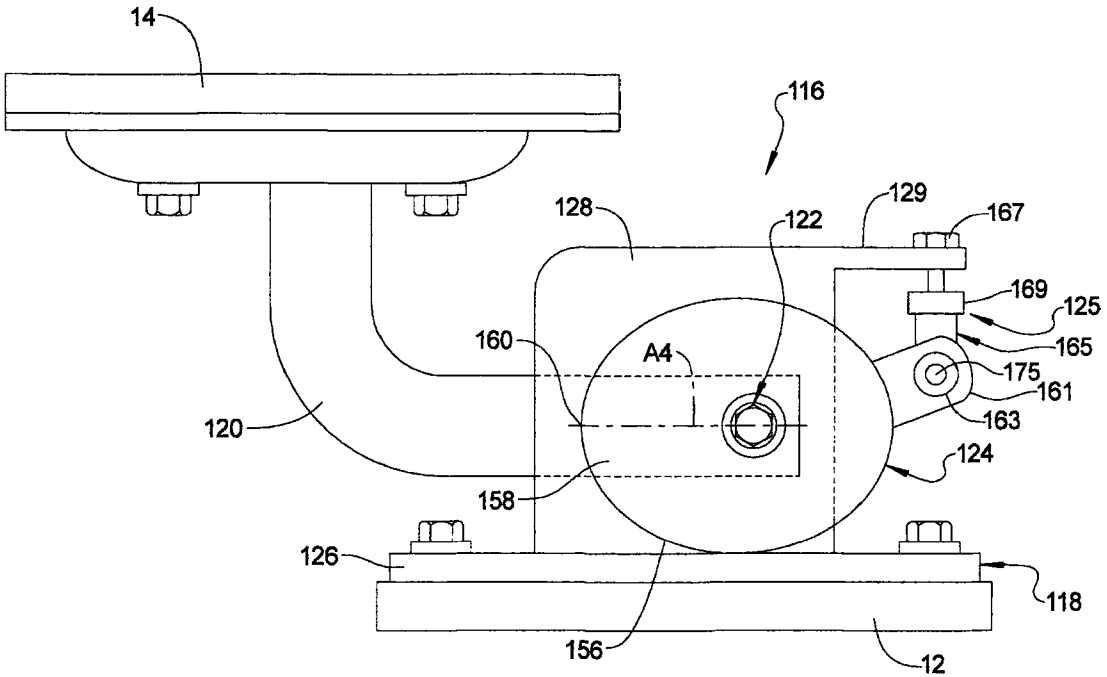
FIG. 7 is a side view of the hinge assembly of FIG. 5.

With reference to FIGS. 5-7, another hinge assembly 116 is provided that may include a hinge bracket 118, a hinge arm 120, a pivot member 122, a cam member 124, and an adjustment linkage 125. The hinge bracket 118, hinge arm 120, pivot member 122, and cam member 124 may be substantially similar to the hinge bracket 18, hinge arm 20, pivot member 22, and cam member 24 described above, apart from any differences noted below. Therefore, substantially similar features may not be described again in detail. Like the hinge assembly 16, the hinge assembly 116 may be connected to the structural member 12 and closure panel 14, may be movable to allow the closure panel 14 to move between the open and closed positions, and may be adjustable to align the closure panel 14 relative to the structural member 12 in the vertical dimension Y.

Like the hinge bracket 18, the hinge bracket 118 may include a first portion 126 and a second portion 128. The second portion 128 may include a slot 132, at least a portion of which may be substantially aligned with an aperture 138 in the hinge arm 120. A body portion 144 of the pivot member 122 may extend through the slot 132 and the aperture 138. The second portion 128 may also include a cantilevered portion 129 extending therefrom. The cantilevered portion 129 may include a threaded hole 131.

The cam member 124 may be a generally oblong disc having an aperture 154 extending therethrough. The cam member 124 may include a peripheral surface 156 defining a lobe 158. The lobe 158 may include a peak 160, which may be defined as the point or portion of the peripheral surface 156 that is further away from the aperture 154 than any other point or portion of the peripheral surface 156. The body portion 144 of the pivot member 22 may extend through the aperture 154 such that the second portion 128 of the hinge bracket 118 is disposed between the cam member 124 and the hinge arm 120. The cam member 124 may be rotatable relative to the hinge bracket 118 about a longitudinal axis A3 of the body portion 144 of the pivot member 122. The cam member 124 may also include a protrusion 161 extending from the peripheral surface 156. The protrusion 161 may include a slot or hole 163 extending therethrough.

The adjustment linkage 125 may include a link member 165, an adjustment member 167, a collar 169, and a nut 171. The link member 165 may include a body portion 173 and a peg 175 extending therefrom. The peg 175 may rotatably engage the hole 163 in the protrusion 161 of the cam member 124, and may be retained therein by a clip 176, for example.

The body portion 173 may include an aperture 177 that may be generally aligned with the hole 131 in the cantilevered portion 129 of the hinge bracket 118. The adjustment member 167 may include a head portion 179 and a threaded elongated portion 181. The elongated portion 181 may extend through and threadably engage the threaded hole 131 in the cantilevered portion 129.

The collar 169 may include a generally U-shaped cross section defining a cavity 183. An aperture 185 may be formed in the collar 169 and may extend into the cavity 183. The elongated portion 181 of the adjustment member 167 may extend through the aperture 185 and into the cavity 183. The nut 171 may be threadably secured to an end of the elongated portion 181 of the adjustment member 167 and may be received in the aperture 177 in the link member 165. The nut 171 and the adjustment member 167 may be freely rotatable within the aperture 177 of the link member 165. An end 184 of the link member 165 may be fixedly received in the cavity 183 of the collar. In some embodiments, the collar 169 may be welded or adhesively bonded to the end 184 of the link member 165.

With continued reference to FIGS. 5-7, assembly and operation of the hinge assembly 116 will be described. The first portion 126 of the hinge bracket 118 may be bolted or otherwise secured to the structural member 12. The body portion 144 of the pivot member 122 may be inserted through the aperture 154 in the cam member 124 and through the slot 132 in the second portion 128 of the hinge bracket 118. The hinge arm 120 can be assembled to the pivot member 122 such that the body portion 144 of the pivot member 122 is received through the aperture 138 in the hinge arm 120.

The adjustment linkage 125 can be assembled to the hinge bracket 118 and the cam member 124 by first threading the elongated portion 181 of the adjustment member 167 through the threaded hole 131 in the cantilevered portion 129. Then, the collar 169 can be slid onto the elongated portion 181 such that the elongated portion 181 is rotatably engaging the aperture 185 of the collar 169. Thereafter, the nut 171 can be threaded onto the elongated portion such that the nut 171 is received in the cavity 183 of the collar 169. The end 184 of the link member 165 can then be inserted into the cavity 183 such that the nut 171 is received in the aperture 177 of the link member 165. The end 184 of the link member 165 can be welded, adhesively bonded or press-fit into engagement with the cavity 183 of the collar 169.

Alignment of the closure panel 14 relative to the structural member 12 in the vertical dimension Y may be adjusted by rotating the cam member 124 about the longitudinal axis A3 to a position such that the peripheral surface 156 of the cam member 124 is in contact with the first portion 126 of the hinge bracket 118. As the cam member 124 is rotated toward a position where the peak 160 of the lobe 158 is in contact with the first portion 126 (i.e., a position where an axis A4 extending between the peak 160 and the aperture 154 is perpendicular to the first portion 126), the pivot member 122 will correspondingly move linearly upward in the vertical dimension Y within the slot 132, and hence the hinge arm 120 and closure panel 14 will correspondingly move linearly upward in the vertical dimension Y relative to the structural member 12. Conversely, rotating the cam member 124 in a direction that moves the peak 160 away from the first portion 126 of the hinge bracket 118 will cause the pivot member 122 to move linearly downward within the slot 132 in the vertical direction Y, which causes the hinge arm 120 and closure panel 14 to move linearly downward in the vertical dimension Y relative to the structural member 12.

The rotational position of the cam member 124 can be adjusted by manipulating the adjustment linkage 125. More specifically, the adjustment member 167 can be rotated within the threaded hole 131 in either direction to move the link member 165 upward or downward in the vertical dimension Y. Because the peg 175 of the link member 165 engages the hole 163 in the protrusion 161 of the cam member 124, upward or downward motion of the link member 165 in the vertical dimension Y relative to the hinge bracket 118 causes corresponding rotation of the cam member 124 about the longitudinal axis A3.

Once the cam member 124 is rotated to a position in which a desired relative alignment between the closure panel 14 and the structural member 12 is achieved, the cam member 124 can optionally be welded, bolted or otherwise fixedly secured to the second portion 128 of the hinge bracket 118 to "lock" the alignment of the closure panel 14 relative to the structural member 12. Of course, even after the cam member 124 is fixedly secured in the desired position relative to the hinge bracket 118, the hinge arm 120 is free to pivot about the longitudinal axis A3 to move the closure panel 14 between the open and closed positions.

Figure 8:
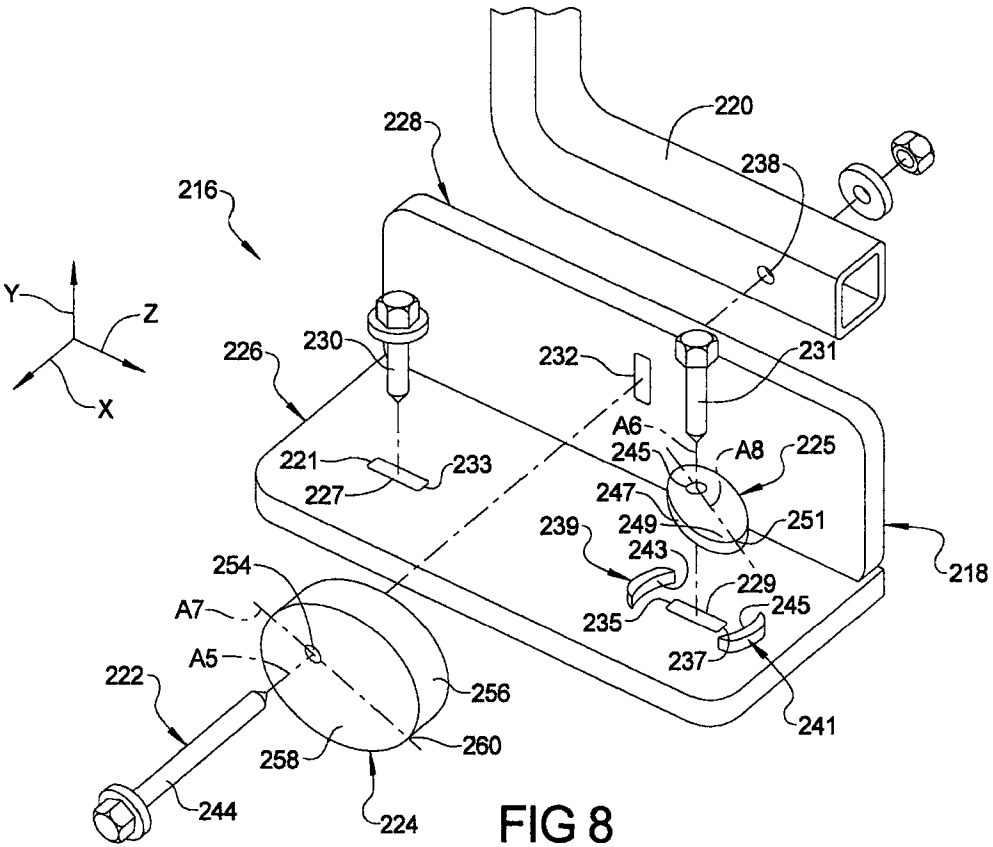
FIG. 8 is an exploded perspective view of yet another hinge assembly according to the principles of the present disclosure.
Figure 9:
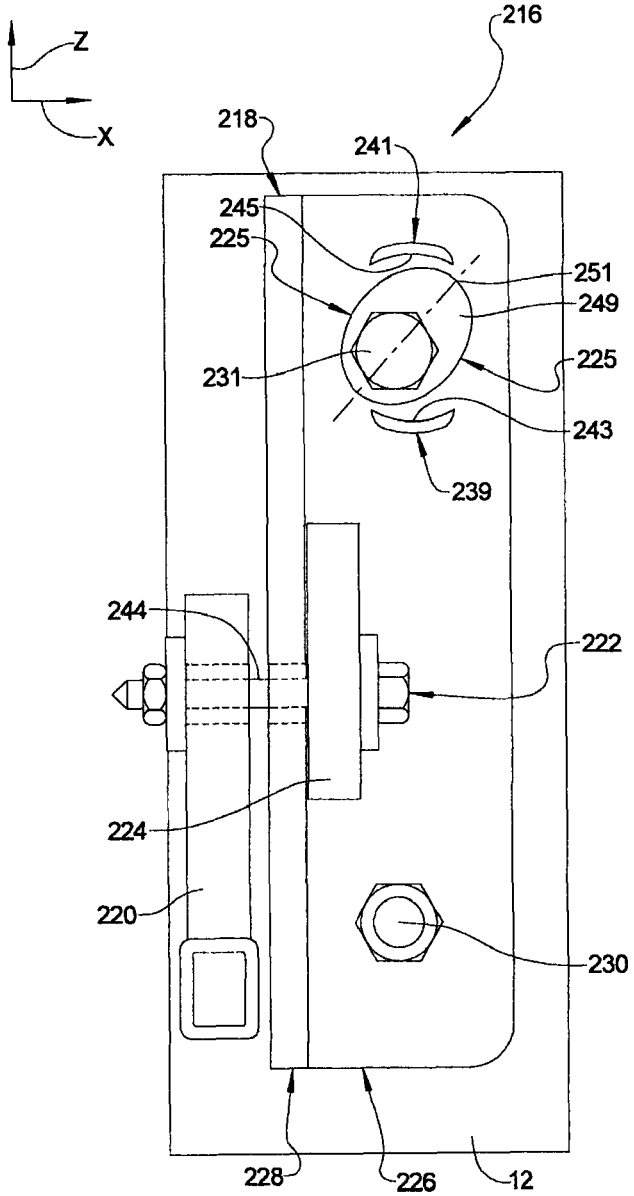
FIG. 9 is a top view of the hinge assembly of FIG. 8.

With reference to FIGS. 8 and 9, another hinge assembly 216 is provided. The hinge assembly 216 may be connected to the structural member 12 and closure panel 14, may be movable to allow the closure panel 14 to rotate between the open and closed positions. As will be subsequently described, the hinge assembly 216 may be adjustable to align the closure panel 14 relative to the structural member 12 in the vertical dimension Y and the fore/aft dimension Z.

The hinge assembly 216 may include a hinge bracket 218, a hinge arm 220, a pivot member 222, a first cam member 224, and a second cam member 225. The hinge bracket 218, hinge arm 220, pivot member 222, and first cam member 224 may be generally similar to the hinge bracket 18, hinge arm 20, pivot member 22, and cam member 24 described above, apart from any differences noted below. Therefore, substantially similar features may not be described again in detail.

The hinge bracket 218 may include a first portion 226 and a second portion 228. The first portion 226 may include first and second slots 227, 229 that may extend through a thickness of the first portion 226. The first and second slots 227, 229 may extend longitudinally in the fore/aft dimension Z. First and second bolts 230, 231 may extend through the first and second slots 227, 229, respectively, and may extend through corresponding apertures (not shown) in the structural member 12. Nuts (not shown) may threadably engage the first and second bolts 230, 231 to prevent the first and second bolts 230, 231 from disengaging the structural member 12 and hinge bracket 218. The first slot 227 may include first and second opposing ends 221, 233, and the second slot 229 may include first and second opposing ends 235, 237.

The first portion 226 may also include first and second reaction members 239, 241 extending therefrom. The first and second reaction members 239, 241 may include first and second reaction surfaces 243, 245, respectively. The first and second reaction surfaces 243, 245 may be concave surfaces that generally face each other. The first and second reaction members 239, 241 may be disposed adjacent the first and second ends 235, 237, respectively, of the second slot 229.

Like the second portion 28 of the hinge bracket 18, the second portion 228 may include a slot 232, at least a portion of which may be substantially aligned with an aperture 238 in the hinge arm 220. A body portion 244 of the pivot member 222 may extend through the slot 232 and the aperture 238.

The first cam member 224 may include an aperture 254 and a peripheral surface 256 defining a lobe 258. The lobe 258 may include a peak 260, which may be defined as the point or portion of the peripheral surface 256 that is further away from the aperture 254 than any other point or portion of the peripheral surface 256. The body portion 244 of the pivot member 22 may extend through the aperture 254, through the slot 232 in the second portion 228 of the hinge bracket 218, and through the aperture 238 in the hinge arm 220. The first cam member 224 may be rotatable relative to the hinge bracket 218 about a longitudinal axis A5 of the body portion 244 of the pivot member 222.

The second cam member 225 may be a generally oblong disc having an aperture 245 extending therethrough and a peripheral surface 247 defining a lobe 249. The lobe 249 may include a peak 251, which may be defined as the point or portion of the peripheral surface 247 that is further away from the aperture 245 than any other point or portion of the peripheral surface 247. The second bolt 231 may extend through the aperture 245, through the second slot 229 and into the structural member 12. In some embodiments, the second cam member 225 may be welded or otherwise secured to the second bolt 231. In some embodiments, the second cam member 225 could be integrally formed with the second bolt 231. The second bolt 231 and the second cam member 225 may be rotatable relative to the hinge bracket 218 about a longitudinal axis A6 defining the second bolt 231.

With continued reference to FIGS. 8 and 9, operation of the hinge assembly 216 will be described. The hinge arm 220 may be mounted to the hinge bracket 218 for pivotable motion relative thereto by inserting the body portion 244 of the pivot member 222 through the slot 232 in the hinge bracket 218 and through the aperture 238 in the hinge arm 220. As described above, the hinge assembly 216 may be operable to adjust a position of the closure panel 14 relative to the structural member 12 in the vertical dimension Y and in the fore/aft dimension Z.

Alignment of the closure panel 14 relative to the structural member 12 in the vertical dimension Y may be adjusted by rotating the first cam member 224 about the longitudinal axis A5 to a position such that the peripheral surface 256 of the first cam member 224 is in contact with the first portion 226 of the hinge bracket 218. As the first cam member 224 is rotated toward a position where the peak 260 of the lobe 258 is in contact with the first portion 226 (i.e., a position where an axis A7 extending between the peak 260 and the aperture 254 is perpendicular to the first portion 226), the pivot member 222 will correspondingly move linearly upward in the vertical dimension Y within the slot 232, and hence the hinge arm 220 and closure panel 14 will correspondingly move linearly upward in the vertical dimension Y relative to the structural member 12. Conversely, rotating the first cam member 224 in a direction that moves the peak 260 away from the first portion 226 of the hinge bracket 218 will cause the pivot member 222 to move linearly downward within the slot 232 in the vertical direction Y, which causes the hinge arm 220 and closure panel 14 to move linearly downward in the vertical dimension Y relative to the structural member 12.

Once the first cam member 224 is rotated to a position in which a desired relative alignment between the closure panel 14 and the structural member 12 is achieved, the first cam member 224 can be welded, bolted or otherwise fixedly secured to the second portion 228 of the hinge bracket 218 to thereby "lock" the vertical alignment of the closure panel 14 relative to the structural member 12. Of course, even after the first cam member 224 is fixedly secured in the desired position relative to the hinge bracket 218, the hinge arm 220 is free to pivot about the longitudinal axis A5 to move the closure panel 14 between the open and closed positions.

Similarly, alignment of the closure panel 14 relative to the structural member 12 in the fore/aft dimension Z may be adjusted by rotating the second cam member 225 about the longitudinal axis A6 to a position such that the peripheral surface 247 of the second cam member 225 is in contact with the first or second reaction surface 243, 245 of the respective first or second reaction member 239, 241. As the second cam member 225 is rotated toward a position where the peak 251 of the lobe 249 is in contact with the first reaction surface 243 (i.e., a position where an axis A8 extending between the peak 251 and the aperture 245 is perpendicular to the longitudinal axis A5), the hinge bracket 218 will correspondingly move linearly forward in the fore/aft dimension Z relative to the structural member 12 (i.e., the hinge bracket 218 is moved such that the second side 237 of the second slot 229 is moved closer to the second bolt 231), and hence the hinge arm 220 and closure panel 14 will correspondingly move linearly forward in the fore/aft dimension Z relative to the structural member 12. Conversely, rotating the second cam member 225 in a direction that moves the peak 251 toward the second reaction surface 245 will cause the hinge bracket 218 to correspondingly move linearly rearward in the fore/aft dimension Z relative to the structural member 12 (i.e., the hinge bracket 218 is moved such that the first side 235 of the second slot 229 is moved closer to the second bolt 231), and hence the hinge arm 220 and closure panel 14 will correspondingly move linearly rearward in the fore/aft dimension Z relative to the structural member 12.

Once the second cam member 225 is rotated to a position in which a desired relative alignment between the closure panel 14 and the structural member 12 is achieved, nuts (not shown) may be secured to ends of the first and second bolts 230, 231 and/or the second cam member 225 can be welded, bolted or otherwise fixedly secured to the first portion 226 of the hinge bracket 218 to thereby "lock" the fore/aft alignment of the closure panel 14 relative to the structural member 12.

It will be appreciated that in some embodiments, the first cam member 224 of the hinge assembly 216 could include structure similar to that of the cam member 124 described above. In such embodiments, the hinge assembly 216 could include structure similar to the adjustment linkage 125 described above to adjust the alignment of the closure panel 14 in the vertical dimension Y.

Figure 10:
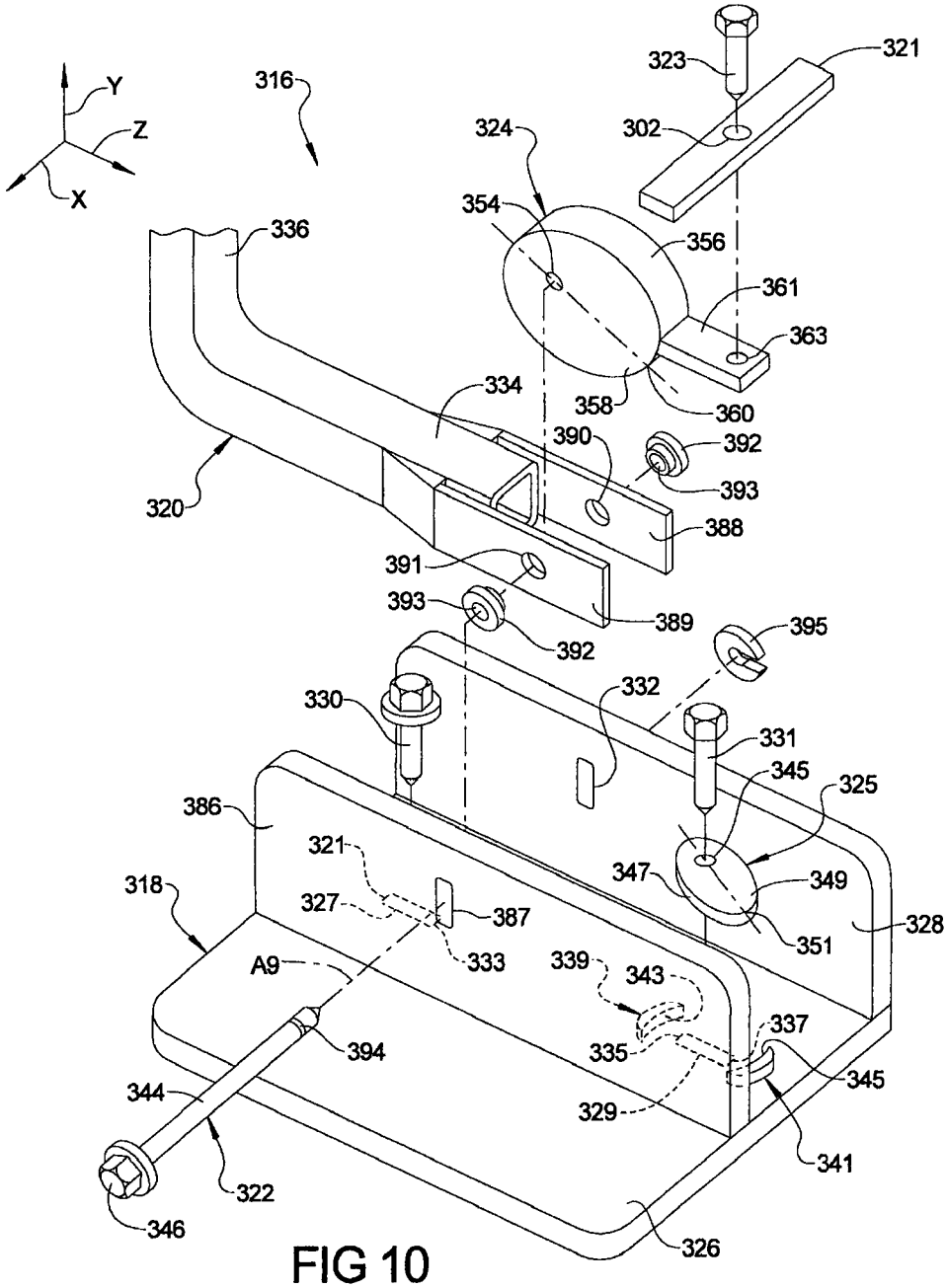
FIG. 10 is an exploded perspective view of still another hinge assembly according to the principles of the present disclosure.
Figure 11:
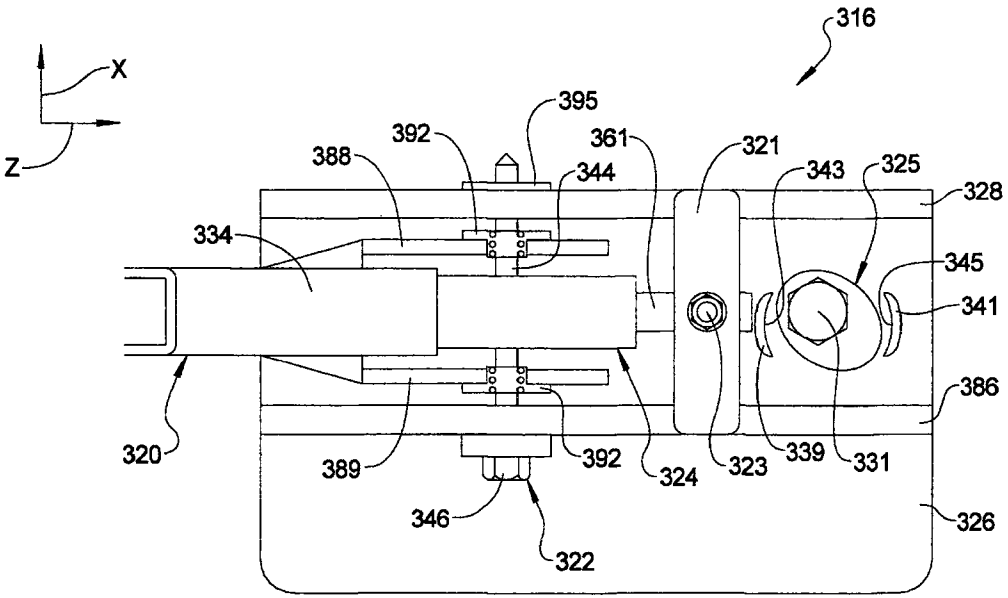
FIG. 11 is a top view of the hinge assembly of FIG. 10.

With reference to FIGS. 10 and 11, another hinge assembly 316 is provided. The hinge assembly 316 may be connected to the structural member 12 and closure panel 14, may be movable to allow the closure panel 14 to rotate between the open and closed positions. As will be subsequently described, the hinge assembly 316 may be adjustable to align the closure panel 14 relative to the structural member 12 in the vertical dimension Y, the fore/aft dimension Z, and the lateral dimension X.

The hinge assembly 316 may include a hinge bracket 318, a hinge arm 320, a pivot member 322, a reaction bracket 321, a threaded adjustment member 323, a first cam member 324, and a second cam member 325.

The hinge bracket 318 may include a first portion 326, a second portion 328, and a third portion 386. The first portion 326 may act as a base of the hinge bracket 318 and may be attached to the structural member 12 via first and second bolts 330, 331. The second and third portions 328, 386 may extend from the first portion 326 and could be integrally formed with the first portion 326 or the first, second and third portions 326, 328, 386 could be discrete pieces that are welded, bolted and/or otherwise fixed relative to each other. The first portion 326 may include first and second slots 327, 329 that may extend through a thickness of the first portion 326. The first and second slots 327, 329 may extend longitudinally in the fore/aft dimension Z. The first and second bolts 330, 331 may extend through the first and second slots 327, 329, respectively, and may threadably engage the structural member 12. The first slot 327 may include first and second opposing ends 321, 333, and the second slot 329 may include first and second opposing ends 335, 337.

The first portion 326 may also include first and second reaction members 339, 341 extending therefrom. The first and second reaction members 339, 341 may include first and second reaction surfaces 343, 345, respectively. The first and second reaction surfaces 343, 345 may be concave surfaces that generally face each other. The first and second reaction members 339, 341 may be disposed adjacent the first and second ends 335, 337, respectively, of the second slot 329.

The second and third portions 328, 386 may include first and second slot 332, 387, respectively. The first and second slots 332, 387 may be substantially aligned with each other. The first and second slots 332, 387 may be elongated in the vertical dimension Y and may extend through thicknesses of the second and third portions 328, 386, respectively, in the lateral dimension X. The reaction bracket 321 may extend between and may be fixedly secured to the second and third portions 328, 386. The reaction bracket 321 may include an aperture 302 that may loosely receive the threaded adjustment member 323.

The hinge arm 320 may include a first portion 334 and a second portion 336. First and second attachment arms 388, 389 may extend from the first portion 334. The first and second attachment arms 388, 389 could be integrally formed with the first portion 334 or the first and second attachment arms 388, 389 could be welded or otherwise fastened thereto. The first and second attachment arms 388, 389 may include first and second apertures 390, 391, respectively. The first and second apertures 390, 391 may be substantially aligned with each other. The first and second attachment arms 388, 389 may be disposed between the second and third portions 328, 386 of the hinge bracket 318 and may be aligned with at least a portion of the first and second slots 332, 387. A bushing 392 may be received in each of the first and second apertures 390, 391, and may be retained therein via welding, adhesive bonding, and/or a press or interference fit, for example. Each of the bushings 392 may include a threaded aperture 393.

The pivot member 322 may include an elongated body portion 344 and a head portion 346. The body portion 344 may be at least partially threaded and may include an annular groove 394 formed therein. The body portion 344 is defined by a longitudinal axis A9 about which the hinge arm 320 may rotate relative to the hinge bracket 318 to move the closure panel 14 between the open and closed positions. The body portion 344 may extend through the first and second slots 332, 387 and an aperture 354 in the first cam member 324 and may threadably engage the threaded apertures 393 of the bushings 392. A clip 395 may snap into engagement with the groove 394 to restrict or prevent movement of the body portion 344 in the lateral dimension X relative to the hinge bracket 318. The clip 395 could be a generally omega-shaped or C-shaped clip, for example, or any other type of clip.

With the clip 395 restricting or preventing movement of the pivot member 322 relative to the hinge bracket 318 in the lateral dimension X, the pivot member 322 can be rotated relative to the bushings 392 to threadably adjust the position of the hinge arm 320 relative to the second and third portions 328, 386 of the hinge bracket 318 in the lateral dimension X. That is, rotation of the pivot member 322 in a first direction relative to the bushings 392 may cause corresponding linear motion of the hinge arm 320 relative to the structural member and the hinge bracket 318 toward the second portion 328 in the lateral dimension X, and rotation of the pivot member 322 in a second direction relative to the bushings 392 may cause corresponding linear motion of the hinge arm 320 relative to the structural member 12 and the hinge bracket 318 toward the third portion 386 in the lateral dimension X. In this manner, the alignment in the lateral dimension X of the closure panel 14 relative to the structural member 12 can be adjusted.

Similar to the cam member 24, the first cam member 324 may include a peripheral surface 356 defining a lobe 358 and a peak 360. The first cam member 324 may also include a protrusion 361 having a threaded aperture 363 extending therethrough. The threaded adjustment member 323 may threadably engage the threaded aperture 363. In this manner, the adjustment member 323 can be rotated within the threaded aperture 363 to cause rotation of the first cam member 324 about the longitudinal axis A9 to adjust the position of the pivot member 322 within the slots 332, 387, thereby adjusting the position of the closure panel 14 relative to the structural member 12 in the vertical dimension Y.

While the hinge assembly 316 is described above as including the reaction bracket 321, adjustment member 323, protrusion 361 and threaded aperture 363 that enable adjustment in the vertical dimension Y, in some embodiments, the hinge assembly 316 may alternatively include structure for adjustment in the vertical dimension Y that is substantially similar to that of the hinge assembly 16, 116 or 216.

The second cam member 325 may be substantially similar to the second cam member 225 described above. Consequently, the hinge assembly 316 may be operable to adjust a position of the closure panel 14 relative to the structural member 12 in the fore/aft dimension Z in substantially the same manner as the hinge assembly 216. Therefore, substantially similar features and functionality may not be described again in detail. Briefly, the second cam member 325 may include an aperture 345 and a peripheral surface 347 defining a lobe 349 and a peak 351. The second bolt 331 may extend through the aperture 345, through the second slot 329 and through the structural member 12.

Alignment of the closure panel 14 relative to the structural member 12 in the fore/aft dimension Z may be adjusted by rotating the second cam member 325 relative to the hinge bracket 318 to a position such that the peripheral surface 247 may contact and exert a force against the first or second reaction surface 243, 245 of the respective first or second reaction member 239, 241. As the second cam member 225 is rotated toward a position where the peak 251 of the lobe 249 is in contact with the first reaction surface 243, the hinge bracket 218 will correspondingly move linearly forward in the fore/aft dimension Z relative to the structural member 12. Conversely, rotating the second cam member 225 in a direction that moves the peak 251 toward the second reaction surface 245 will cause the hinge bracket 218 to correspondingly move linearly rearward in the fore/aft dimension Z relative to the structural member 12.

What is claimed is:

1. A hinge assembly comprising:

a hinge bracket adapted to be mounted to a frame member of a vehicle, the hinge bracket including a first slot extending in a first direction;

a pivot member having a longitudinal axis and extending through the first slot of the hinge bracket perpendicular to the first direction, the pivot member being movable within the first slot relative to the hinge bracket in the first direction; and a first cam member coupled to the pivot member and being rotatable relative to the hinge bracket and the hinge arm about the longitudinal axis and including a peripheral surface contacting the hinge bracket; and a hinge arm connected to the pivot member and being pivotable relative to the hinge bracket about the longitudinal axis of the pivot member, the hinge arm threadably engaging the pivot member;

wherein rotation of the first cam member moved the pivot member within the first slot, thereby linearly adjusting the hinge arm in the first direction relative to the hinge bracket, and wherein rotation of the pivot member relative to the hinge arm linearly adjusts the hinge arm in a second direction relative to the hinge bracket, the first and second directions being substantially perpendicular to each other, the hinge arm being adapted to be coupled to a closure panel of the vehicle to move the closure panel relative to the frame member between an open position and a closed position.

2. The hinge assembly of claim 1, further comprising a pivot pin attached to the hinge bracket and a second cam member engaging the pivot pin for pivotable motion relative to the hinge bracket.

3. The hinge assembly of claim 2, wherein the hinge bracket includes a base portion and an upright portion extending from the base portion, the base portion including a reaction member extending therefrom and engaging a peripheral surface of the second cam member, and wherein rotation of the second cam member relative to the hinge bracket exerts a force on the reaction member causing linear movement of the hinge bracket relative to the frame member of the vehicle.

4. The hinge assembly of claim 3, wherein pivotal motion of the second cam member relative to the hinge bracket causes corresponding linear adjustment of the hinge bracket in a third direction that is perpendicular to the first and second directions.

5. The hinge assembly of claim 4, further comprising a pivot bushing fixedly engaging the hinge arm and threadably engaging the pivot member.

6. The hinge assembly of claim 5, wherein threadable adjustment of the pivot member relative to the pivot bushing causes corresponding linear adjustment of the hinge arm relative to the hinge bracket in the second direction.

7. The hinge assembly of claim 6, wherein the first direction is perpendicular to the second direction and the first and second directions are perpendicular to the third direction.

8. The hinge assembly of claim 1, wherein the closure panel includes a hood of the vehicle.

9. A vehicle comprising:

a frame member;

a hinge bracket adapted to be mounted to the frame member;

a pivot member connected to the hinge bracket, the pivot member being pivotable relative to the hinge bracket;

a hinge arm connected to the pivot member and being pivotable about a longitudinal axis of the pivot member, the hinge arm being linearly adjustable relative to the hinge bracket and being adapted to be coupled to a closure panel of the vehicle to move the closure panel relative to the frame member between an open position and a closed position; and a first cam member coupled to the pivot member and being pivotable relative to the hinge bracket and the hinge arm about the longitudinal axis, the first cam member including a peripheral surface contacting the hinge bracket, wherein pivotal motion of the first cam member relative to the hinge bracket causes corresponding linear adjustment of the pivot member.

10. The vehicle of claim 9, wherein the hinge bracket includes a base portion and an upright portion extending from the base portion, the base portion including a reaction member extending therefrom and engaging a peripheral surface of a second cam member, and wherein rotation of the second cam member relative to the hinge bracket exerts a force on the reaction member causing linear movement of the hinge arm relative to the frame member of the vehicle.

11. The vehicle of claim 10, wherein the hinge arm is independently movable in first and second directions relative to the frame member, the first and second directions being substantially perpendicular to each other, wherein movement of the first cam member causes movement of the hinge arm in the first direction and movement of the second cam member causes movement of the hinge arm in the second direction.

12. The vehicle of claim 11, wherein the pivot member threadably engages the hinge arm and is pivotable relative to the hinge arm to move the hinge arm in a third direction relative to the frame member, the third direction being substantially perpendicular to the first and second directions.

13. The vehicle of claim 9, further comprising an adjustment member coupled to the hinge bracket and threadably connected to the first cam member, wherein movement of the adjustment member causes corresponding movement of the first cam member.

14. The vehicle of claim 9, wherein the closure panel includes a hood of the vehicle.

15. The vehicle of claim 9, further comprising a pivot bushing fixedly engaging the hinge arm and threadably engaging the pivot member.

16. The vehicle of claim 15, wherein threadable adjustment of the pivot member relative to the pivot bushing causes corresponding linear adjustment of the hinge arm relative to the frame member.

17. The vehicle of claim 9, wherein the hinge bracket includes a base portion mounted to the frame member and an upright portion extending from the base portion, the upright portion including a slot in which the pivot member is received.

* * * * *